US005886674A

United States Patent [19]

Yoshimi

[11] Patent Number: 5,886,674

[45] Date of Patent: Mar. 23, 1999

[54] ANTENNA MOUNT

[75] Inventor: Akitoshi Yoshimi, Tokyo, Japan

[73] Assignee: Mitsubishi Denki Kabushiki Kaisha, Japan

[21] Appl. No.: 806,290

[22] Filed: Feb. 26, 1997

[30] Foreign Application Priority Data

Feb. 29, 1996 [JP] Japan ..... 8-043300

[51] Int. Cl.[6] ..... H01Q 1/32

[52] U.S. Cl. ..... 343/882; 343/713; 343/878

[58] Field of Search ..... 343/713, 715, 343/882, 880, 757, 878; 248/539, 551, 223.21, 222.41; 403/348, 350; 285/360, 361, 376, 396, 401, 402; H01Q 1/32

[56] References Cited

U.S. PATENT DOCUMENTS 3,859,928 1/1975 Adler ..... 105/199
4,773,788 9/1988 Ruhl ..... 403/348
4,928,805 5/1990 Takeuchi et al. ..... 192/106.2
5,585,809 12/1996 Yajima et al. ..... 343/713

FOREIGN PATENT DOCUMENTS 4225604 8/1992 Japan .
2 120 856 12/1983 United Kingdom ..... H01Q 3/08

*Primary Examiner*—Don Wong
*Assistant Examiner*—Hoang Nguyen
*Attorney, Agent, or Firm*—Rothwell, Figg, Ernst & Kurz, P.C.

[57] ABSTRACT

An antenna mount is comprised of a base plate, an antenna mounting base to be mounted on the base surface of an antenna, and guide pins having a frange which are secured to the base plate. The antenna mounting base have insertion portions and retaining portions. The flanges of the guide pins are retained by the retaining portion, by inserting the guide pins into the insertion portion and rotaing the base plate and the antenna mounting base relative to one another. Accordingly, an antenna is obtained whereby mounting and removing of the antenna can be easily performed.

11 Claims, 12 Drawing Sheets

ANTENNA MOUNT

BACKGROUND OF THE INVENTION

1. Field of the Invention

The present invention relates to an antenna mount for mounting an antenna on, e.g., the roof, trunk, etc., of a vehicle.

2. Description of the Related Art

FIG. 23 is a perspective view of a flat automobile antenna mounted on the trunk of an automobile (refer to Japanese Patent Laid open 4-225604). The antenna 2 is fixed to the automobile trunk 1 by means of double-sided adhesive tape 3.

The known antenna 2 is fixed to the automobile trunk 1 by means of double-sided adhesive tape 3, and in the event that the antenna 2 must be removed from the automobile for repair of the antenna 2 or replacement thereof, the double-coated adhesive tape 3 which firmly adheres to the trunk 1 and the antenna 2 obstructs removal of the antenna 2, and consequently, such an arrangement has caused problems because removal of the antenna 2 from the automobile can not be conducted in a smooth manner.

SUMMARY OF THE INVENTION

Accordingly, the present invention has been made in order to deal with the problems such as described above, and the object thereof is to provide an antenna mount whereby mounting and removal of the antenna can be conducted easily.

It is another object of the present invention to provide an antenna mount wherein a base plate can be mounted to an antenna receiving member in a secure manner.

It is yet another object of the present invention to provide an antenna mount wherein the antenna does not rotate and become dislodged due to vibrations.

It is a further object of the present invention to provide an antenna mount wherein bolts or sliders do not come loose during the process of removing the antenna.

The antenna mount according to the present invention comprises: a base plate, an antenna mounting base to be mounted on the base surface of an antenna; and a plurality of guide pins each having a flange and being secured either to the aforementioned base plate or to the aforementioned antenna mounting base, wherein guide holes are formed in whichever of the aforementioned base plate or the aforementioned antenna mounting base the aforementioned guide pins are not secured, the aforementioned guide holes further comprising insertion portions into which the aforementioned guide pins are inserted and retaining portions by means of which retaining of the aforementioned guide pins are performed, and wherein the aforementioned flanges of the aforementioned guide pins are retained by the aforementioned retaining portions, by means of inserting the aforementioned guide pins into the aforementioned insertion portions and rotating the aforementioned base plate and the aforementioned antenna mounting base relative to one another.

Also, the antenna mount according on the present invention is provided with a doughnut-shaped plate as the aforementioned base plate.

Further, the antenna mount according to the present invention further comprises rotation prevention means for preventing rotation of the aforementioned antenna mounting base to be provided to the aforementioned base plate.

Further yet, the antenna mount according to the present invention is provided with the aforementioned rotation prevention means which further comprise: a slider provided on the aforementioned base plate; a slider guide fixed to the aforementioned base plate and having a screw hole; and a bolt having a head, the aforementioned bolt being movably inserted into a hole formed in the aforementioned slider and screwed into the aforementioned screw hole; wherein the advancement of the aforementioned bolt being screwed into the aforementioned screw hole causes advancement of the aforementioned slider so as to effectuate engagement of the aforementioned slider with the aforementioned antenna mounting base.

Moreover, the antenna mount according to the present invention is provided with the aforementioned antenna mounting base which is provided with a concave portion into which the leading edge of the aforementioned slider is inserted.

Moreover, the antenna mount according to the present invention is arranged such that the aforementioned base plate is provided with a retaining member which faces a retaining hole provided in the aforementioned slider and cooperates with the aforementioned retaining hole so as to restrict the amount of retraction of the aforementioned slider.

Also, the antenna mount according to the present invention is arranged such that the aforementioned slider is provided with a bolt abutting member which abuts the aforementioned bolt and causes the aforementioned slider to follow retraction of the aforementioned bolt.

Further, the antenna mount according to the present invention is arranged such that the axial line of the aforementioned bolt is arranged so as to intersect the direction of motion of the slider portion of the aforementioned slider which slidably moves upon the aforementioned base plate.

Also, the antenna mount according to the present invention further comprises motion restriction means provided between the aforementioned flange of the aforementioned guide pins and the aforementioned antenna mounting base, so as to restrict movement of the aforementioned guide pins in the radial and axial directions.

Further, the antenna mount according to the present invention is arranged such that the aforementioned motion restriction means comprises protrusions provided in the vicinity of the aforementioned retaining portions of the aforementioned guide holes.

Moreover, the antenna mount according to the present invention is arranged such that the aforementioned motion restriction means further comprises: U-shaped springs which grip the aforementioned guide pins in an resilient manner; tunnel-shaped guide portions which are formed in the aforementioned antenna mounting base by means of raising a portion of the aforementioned antenna mounting base, the aforementioned springs being inserted thereto; and positioning portions which are formed in the aforementioned antenna mounting base for positioning the aforementioned springs to be inserted into the aforementioned guide portions.

DESCRIPTION OF THE PREFERRED EMBODIMENTS

First Embodiment

Figure 1:
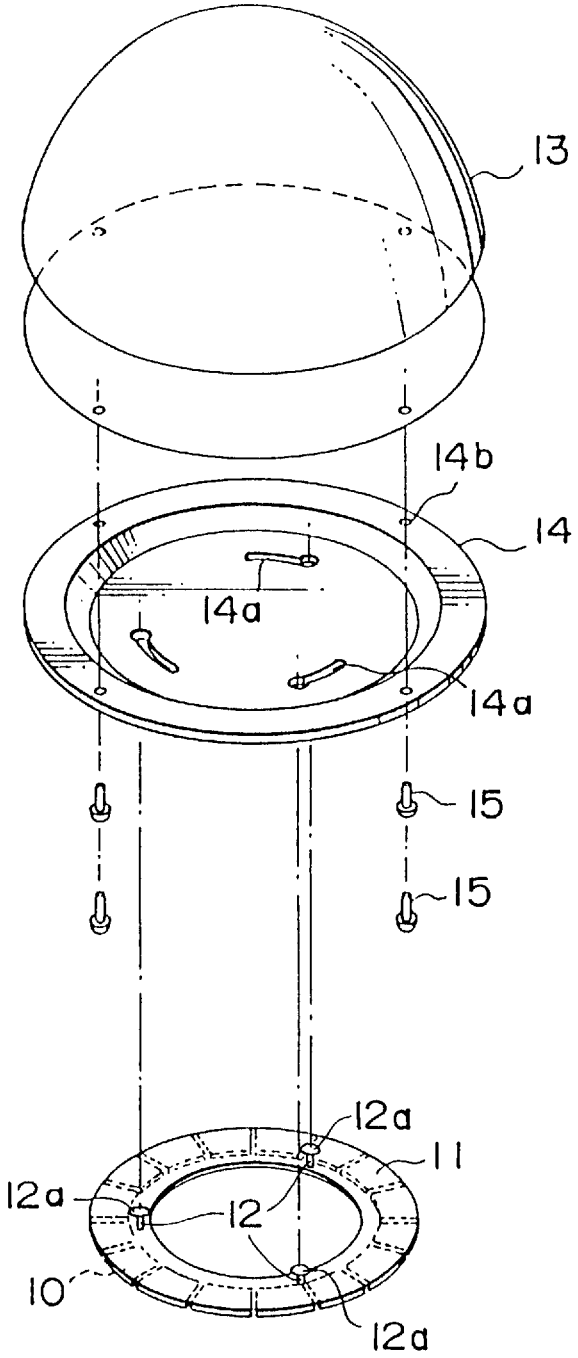
FIG. 1 is a disassembled perspective view illustrating an embodiment of the present invention.
Figure 2:
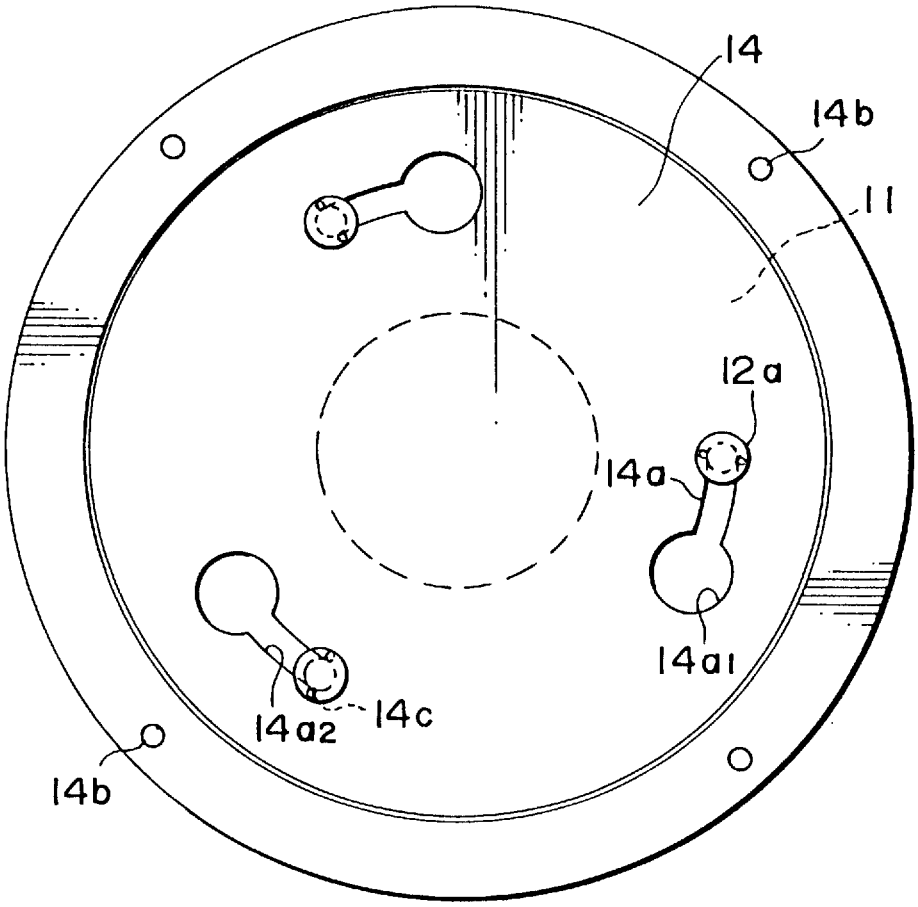
FIG. 2 is a plan view of the antenna mount shown in FIG. 1.
Figure 3:
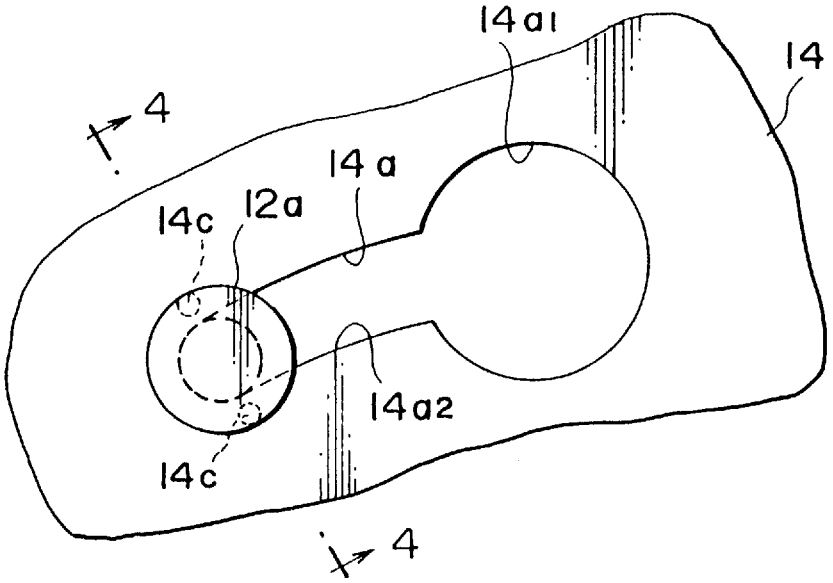
FIG. 3 is an enlarged view of the principal portion of FIG. 2.
Figure 4:
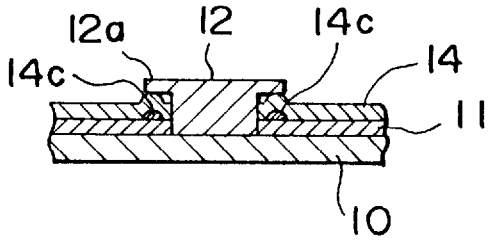
FIG. 4 is a cross-section drawing viewed along line A—A shown in FIG. 3.

A fist embodiment according to the present invention will now be described. FIG. 1 is a disassembled perspective view illustrating an embodiment of the present invention, FIG. 2 is a plan view of the antenna mount shown in FIG. 1, FIG. 3 is an enlarged view of the principal portion of FIG. 2, and FIG. 4 is a cross-section drawing viewed along line A—A shown in FIG. 3. The antenna mount is comprised of a doughnut-shaped base plate 11 which is fixed by means of double-sided adhesive tape 10 to an automobile trunk (not shown) which serves as an antenna receiving member, guide pins 12 which have flanges 12*a* to prevent pulling out and which are therefore fixed to this base plate 11, and an antenna mounting base 14 which is fixed by means of bolts 15 to the base surface of the antenna 13 and which has guide holes 14*a* extending in the circumferencial direction.

The doughnut-shaped base plate 11 is formed of aluminum material coated with hard alumite on the surface thereof. Three guide pins 12 formed of stainless steel and having a T-shaped cross-sectional configuration are fixed to the base plate 11, being spaced one from another.

The antenna mounting base 14 which is shaped like a plate with a concave center portion has three guide holes 14*a* each of which are extended in the circumferencial direction, and a screw hole 14*b* through which the bolt 15 passes so as to fix the antenna mounting base 14 to the antenna 13. The guide holes 14*a* are each formed of an insertion portion $\mathbf{14}a_1$, with a large diameter into which the guide pins 12 are inserted, and a narrow slit-shaped retaining portion $\mathbf{14}a_2$ at which the guide pins 12 are retained. In the vicinity of the end portion of the retaining portion $\mathbf{14}a_2$ are formed a pair of opposing protrusions 14*c* which serve as motion restriction means.

In order to use the above-described antenna mount to mount an antenna 13 to the trunk of an automobile, the antenna mounting base 14 is fixed to the antenna 13 beforehand, by means of the bolts 15. Next, the antenna mounting base 14 is placed so as to cover the base plate 11 which has been fixed to the trunk of the automobile by means of double-sided adhesive tape 10, such that the guide pins 12 are inserted into the insertion portions $\mathbf{14}a_1$. Subsequently, the antenna 13 is rotated in a clockwise direction as viewed from above, so that the guide pins 12 are situated at the edge position of the retaining portions $\mathbf{14}a_2$. At this position, the flanges 12*a* of the guide pins 12 are pressed against the protrusions 14*c*, so that the antenna mounting base 14 is firmly yet easily fixed to the base plate 11 so that there is no movement thereof in either vertical or radial directions.

On the other hand, when the antenna 13 is to be removed from the trunk, the antenna 13 is rotated in a counterclockwise direction as viewed from above, so that the flange 12*a* of the guide pins 12 are dislocated from the position of being pressed against the protrusions 14*c* and are moved to the insertion portions $\mathbf{14}a_1$, thus disengaging the engagement between the guide pins 12 and the antenna mounting base 14, and consequently facilitating simple removal of the antenna 13 from the trunk of the automobile.

Also, the base plate 11 is formed as a doughnut-shaped plate, so that even when the curvature of the surface to which it is to be attached is great, the base plate 11 is more capable of following the curvature thereof than a plate-shaped base plate, resulting in a more stable fixing of the base plate 11 to the antenna receiving member.

Although the above embodiment describes guide pins 12 being fixed to the base plate 11 and guide holes 14*a* being formed in the antenna mounting base 14, the guide pins may be fixed to the antenna mounting base and the guide holes formed in the base plate.

Second Embodiment

Figure 5:
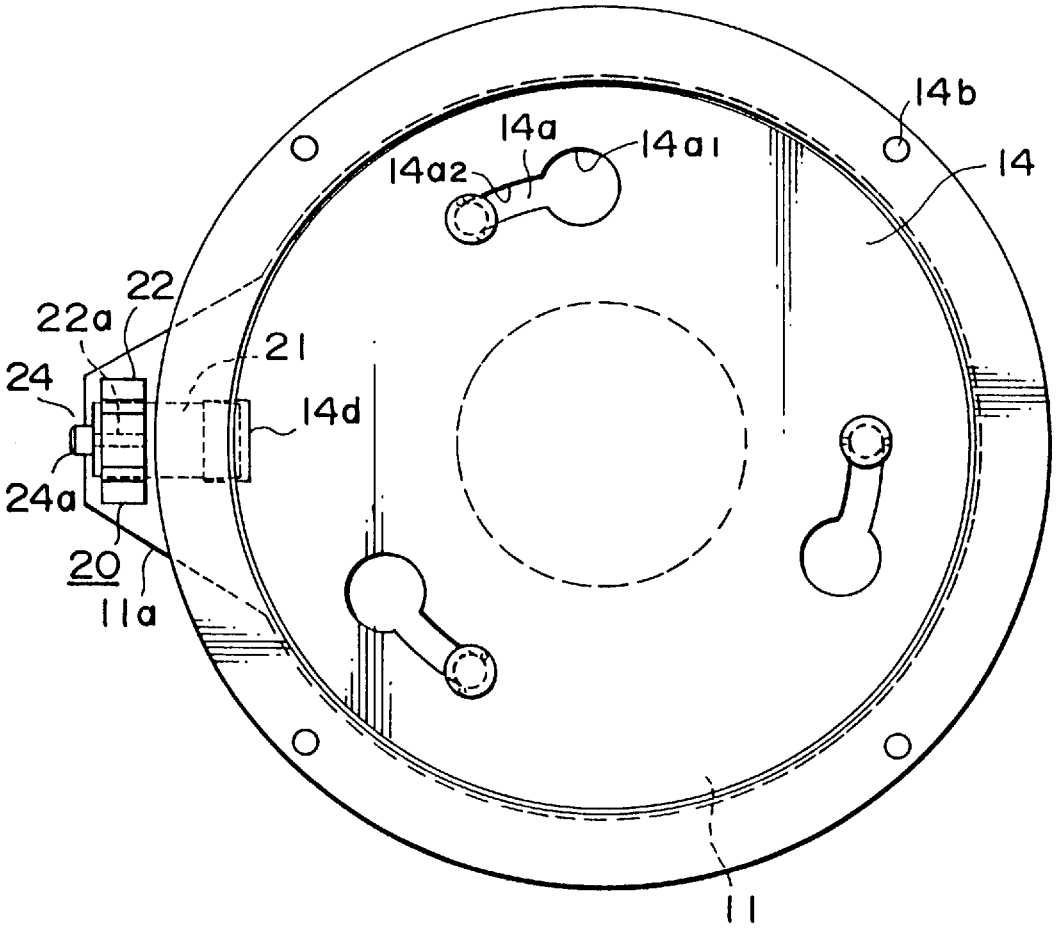
FIG. 5 is a plan view of an antenna mount illustrating another embodiment of the present invention.
Figure 6:
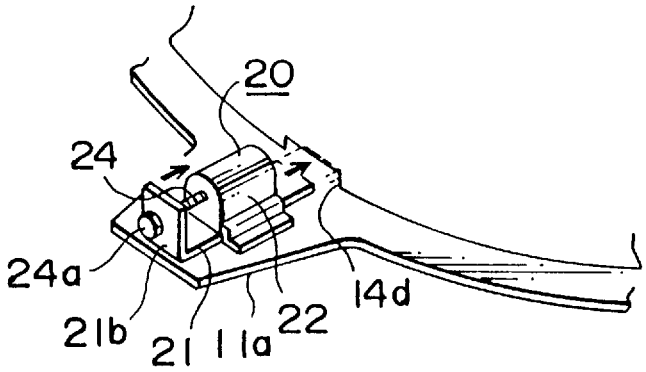
FIG. 6 is a perspective view of the principal portion of FIG. 5.
Figure 7:
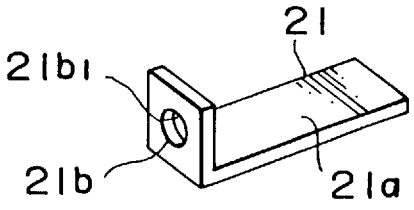
FIG. 7 is a perspective view of the slider shown in FIG. 5.

FIG. 5 is a plan view of an antenna mount illustrating another embodiment of the present invention, FIG. 6 is a perspective view of FIG. 5, and FIG. 7 is a perspective view of the slider shown in FIG. 5.

With the present embodiment, the antenna mount is provided with rotation prevention means 20 so as to prevent the antenna mounting base 14 from rotating in relation to the base plate 11.

The rotation prevention means 20 is comprised of an L-shaped slider 21 shown in FIG. 7 which is provided slidably relative to the receiving portion 11*a* on the periphery of the base plate 11, a slider guide 22 which has a screw hole 22*a* and which is fixed to the receiving portion 11*a* so as to straddle the slider 21, and a bolt 24 with a head 24*a* which is movably inserted thorough a hole $\mathbf{21}b_1$, in the shorter side of the slider 21 serving as the seat 21*b* so as to screw into the screw hole 22*a*. A concave portion 14*d* is formed on the side of the antenna mounting base 14 to which the leading edge of the slider 21 is inserted.

The steps for using the above-described antenna mount to mount an antenna 13 to the trunk of an automobile are the same as those of the first embodiment as far as causing the flanges 12*a* of the guide pins 12 to be pressed against the protrusions 14*c* so as to mount the antenna mounting base 14 to the base plate 11. Subsequently, in order to insert the leading edge of the slider 21 into the concave portion 14*d*, the head 24*a* of the bolt 24 is rotated in a clockwise direction. That is to say, rotating the bolt 24 in a clockwise direction causes the bolt 24 to be screwed into the screw hole 22*a* of the slider guide 22, whereby the head 24*a* presses the seat 21*b* so that the slider portion 21*a* of the slider 21 slides over the receiving portion 11*a* in the direction shown by the arrow in FIG. 6, and thus the leading edge of the slider 21 is inserted into the concave portion 14*d*.

In order to remove the antenna 13 from the trunk, first, the bolt 24 is rotated in a counter-clockwise direction so as to retract the bolt 24 from the screw hole 22*a*. At this time, the slider 21 does not follow the movement of the bolt 24, since the bolt 24 is movably inserted in the hole 21$b_1$, of the seat 21*b*. The engagement between the slider 21 and the concave portion 14*d* is disengaged by means of retracting the slider 21 to where the seat 21*b* of the slider 21 abuts the head 24*a* of the bolt 24, once the head 24*a* of the bolt 24 has been removed a certain distance from the seat 21*b*.

Subsequently, the antenna 13 is rotated in a counter-clockwise direction as viewed from above, so that the guide pins 12 are dislocated from the position of being pressed against the protrusions 14*c* and are moved to the insertion portions 14$a_1$, thus disengaging the engagement between the base plate 11 and the guide pins 12, and consequently facilitating simple removal of the antenna 13 from the trunk of the automobile.

Although a concave portion 14*d* has been formed on the side of the antenna mounting base 14 to which the leading edge of the slider 21 is inserted with the above-described embodiment, a hole may be formed instead of a concave portion. Also, there may occasions where it is sufficient to press the leading edge of the slider 21 against the side of the antenna mounting base, instead of forming concave portions or holes therein.

Third Embodiment

Figure 8:
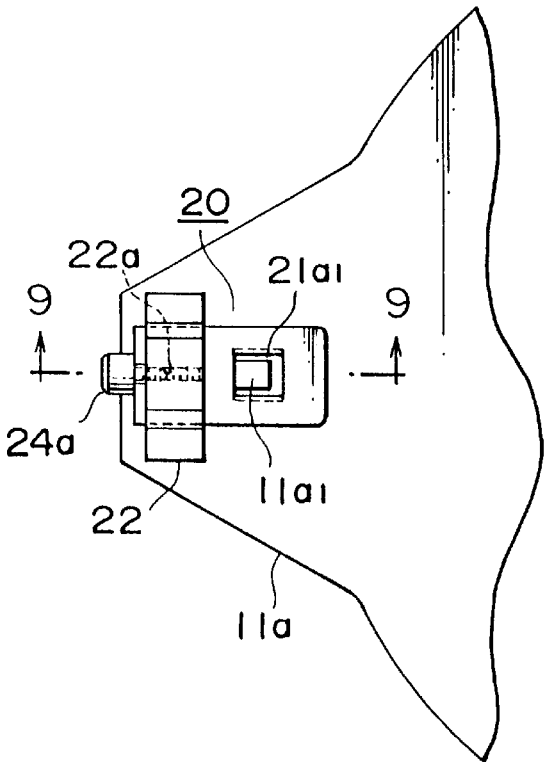
FIG. 8 is a partial plan view of the base plate illustrating another embodiment of the present invention.
Figure 9:
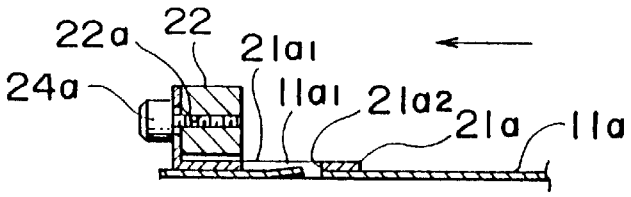
FIG. 9 is a cross-section drawing viewed along line B—B shown in FIG. 8.
Figure 10:
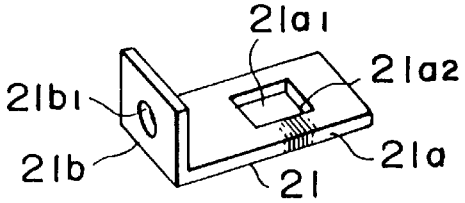
FIG. 10 is a perspective view of the slider shown in FIG. 8.

FIG. 8 is a partial plan view of the base plate illustrating another embodiment of the present invention, FIG. 9 is a cross-section drawing viewed along line B—B shown in FIG. 8, and FIG. 10 is a perspective view of the slider shown in FIG. 8.

The present embodiment differs from the second embodiment in that a retaining hole 21$a_1$, is formed at the central portion of the slider portion 21*a* of the slider 21 which comprises the rotation prevention means 20.

The leading edge of a tongue piece 11$a_1$, serving as a retaining piece formed on the receiving portion 11*a* faces this retaining hole 21$a_1$, and is arranged so that the edge plane of the retaining hole 21*a* abuts the leading edge of the tongue piece 11$a_1$, when the slider 21 is retracted in the direction shown by an arrow in FIG. 9. Accordingly, the amount of retraction of the slider 21 is restricted, and thus such a situation where the slider 21 falls out from the base plate 11 and becomes lost is prevented.

Fourth Embodiment

Figure 11:
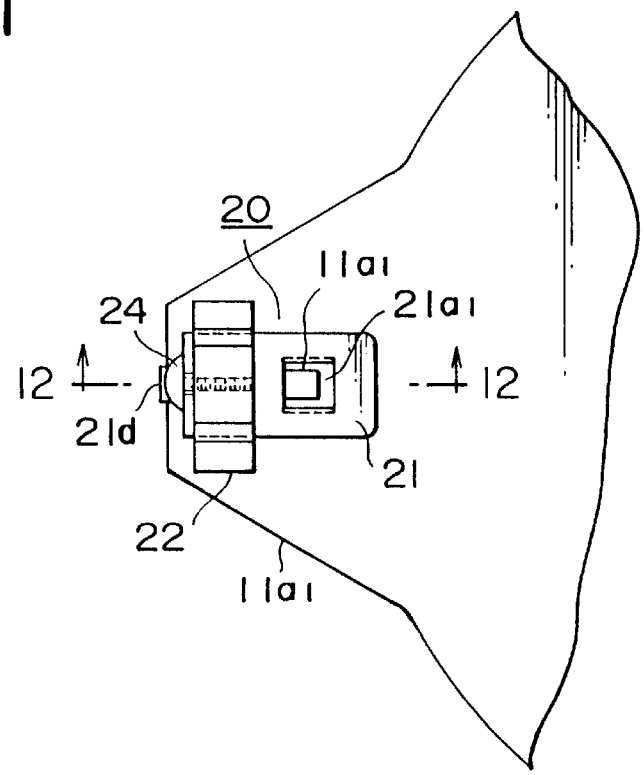
FIG. 11 is a partial plan view of the base plate illustrating another embodiment of the present invention.
Figure 12:
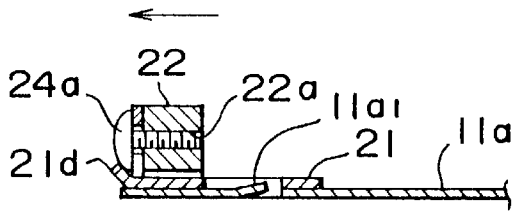
FIG. 12 is a cross-section drawing viewed along line C—C shown in FIG. 11.
Figure 13:
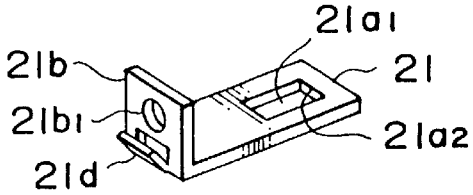
FIG. 13 is a perspective view of the slider shown in FIG. 11.

FIG. 11 is a partial plan view of the base plate 11 illustrating another embodiment of the present invention, FIG. 12 is a cross-section drawing viewed along line C—C shown in FIG. 11, and FIG. 13 is a perspective view of the slider shown in FIG. 11.

The present embodiment differs from the third embodiment in that a bolt abutting portion 21*d* is formed on the seat portion 21*b* of the slider 21. The head 24*a* of the bolt 24 abuts the bolt abutting portion 21*d* so as to be rotatable in the direction of rotation of the bolt 24.

Accordingly, upon performing retraction of the bolt 24 from the screw hole 22*a* by means of rotating the bolt 24 in a counter-clockwise direction, the head 24*a* of the bolt 24 abuts the bolt abutting portion 21*d*, so that the slider 21 follows the retracting motion of the bolt 24, thus improving the ease of work of removing the antenna 13.

Further, retraction of the slider 21 is stopped at the point where the edge surface 21$a_2$ of the retaining hole 21*a* abuts the leading edge of the tongue piece 11$a_1$, thus stopping any further rotation of the bolt 24, and consequently preventing a situation where the bolt 24 falls out from the slider guide 22 and becomes lost.

Fifth Embodiment

Figure 14:
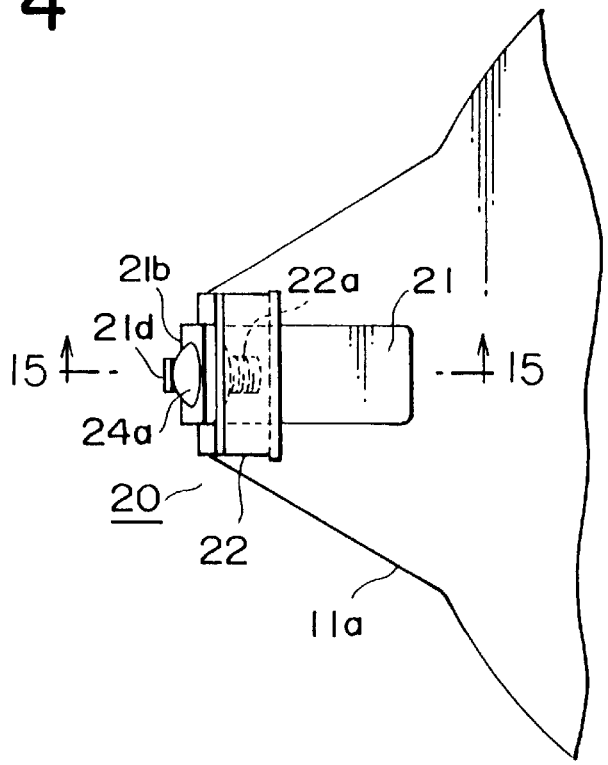
FIG. 14 is a partial plan view of the base plate illustrating another embodiment of the present invention.
Figure 15:
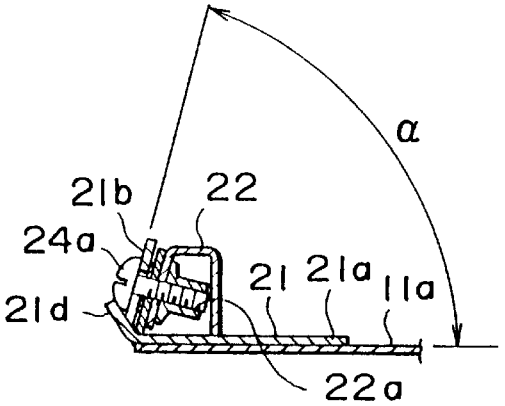
FIG. 15 is a cross-section drawing viewed along line D—D shown in FIG. 14.
Figure 16:
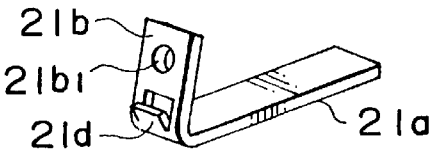
FIG. 16 is a perspective view of the slider shown in FIG. 14.

FIG. 14 is a partial plan view of the base plate illustrating another embodiment of the present invention, FIG. 15 is a cross-section drawing viewed along line D—D shown in FIG. 14, and FIG. 16 is a perspective view of the slider shown in FIG. 14.

With the present embodiment, the angle formed between the slider portion 21*a* of the slider 21 and the seat portion 21*b* thereof is an acute angle $\alpha$.

Figure 17:
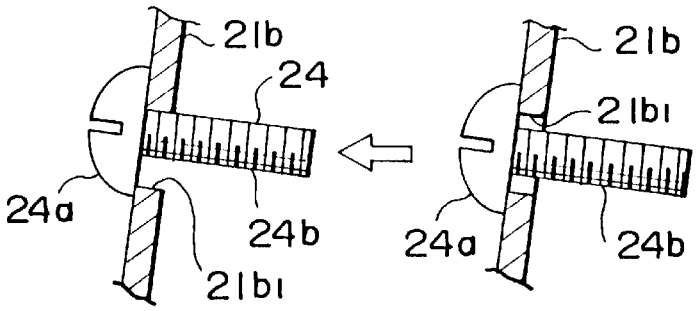
FIG. 17 is an explanatory diagram illustrating the positional relation between the bolt and slider.

According to the present embodiment, when the bolt 24 is retracted from the screw hole 22*a* by means of rotating the bolt 24 in a counter-clockwise direction, the head 24*a* of the bolt 24 abuts the bolt abutting portion 21*d*, so that the slider 21 follows the retracting motion of the bolt 24. When the slider 21 has moved a certain distance, the engagement between the slider 21 and the concave portion 14*d* is disengaged. Further, in the event that the bolt 24 continues to be rotated in a counter-clockwise direction, the bolt 24 comes to a point where it can not be moved any further. That is to say, the slider portion 21*a* of the slider 21 moves in a horizontal direction, and the seat portion 21*b* thereof also moves in a horizontal direction, the bolt moves at a certain angle from the horizontal direction, meaning that the bolt 24 comes to be located at a position removed from the slider portion 21*a* in conjunction with the rotation thereof, and accordingly, the threaded shaft portion 24*b* of the bolt 24 is pressed against the inner wall surface of the hole 21$b_1$, of the seat portion 21*b*, as shown in FIG. 17. Accordingly, the bolt 24 is prevented from any further rotation, thus preventing a situation where the bolt 24 falls out from the slider guide 22 and becomes lost.

Although the present embodiment has been described with the angle formed between the slider portion 21*a* of the slider 21 and the seat portion 21*b* thereof as an acute angle, this angle may be an obtuse angle. That is to say, the purpose thereof can be served as long as the relational position of the bolt and the slider is such that the axial direction of the bolt 24 and the direction of movement of the slider 21 intersect.

Sixth Embodiment

Figure 18:
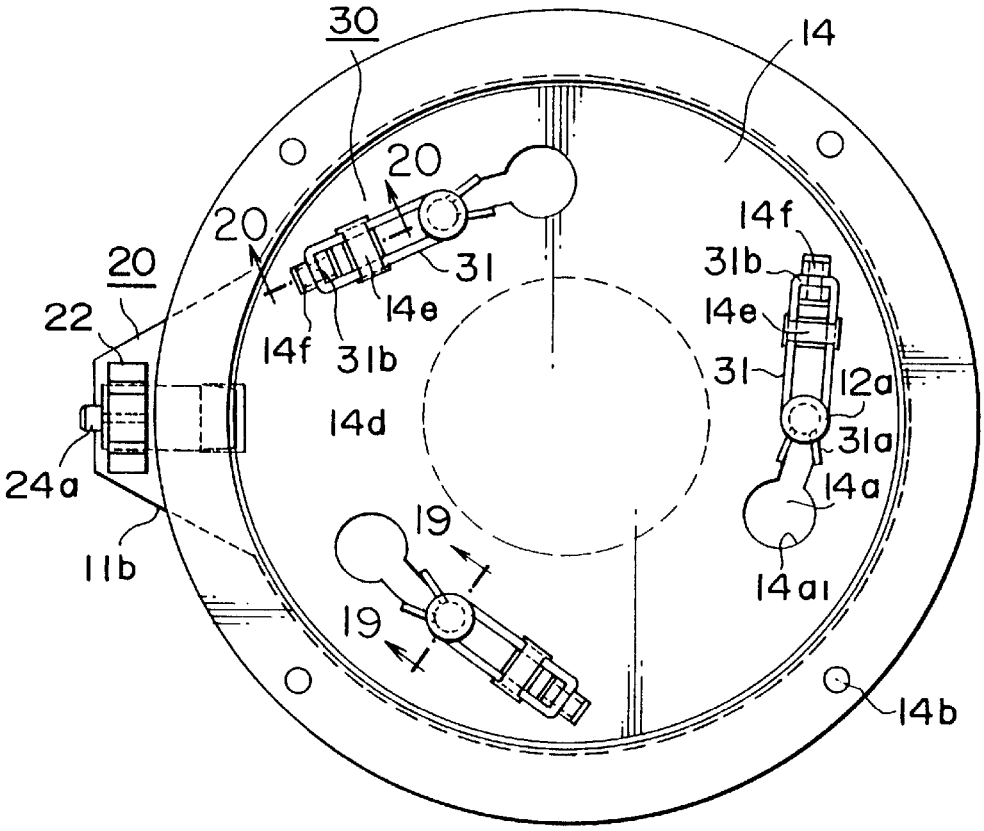
FIG. 18 is a plan view of an antenna mount illustrating another embodiment of the present invention.
Figure 19:
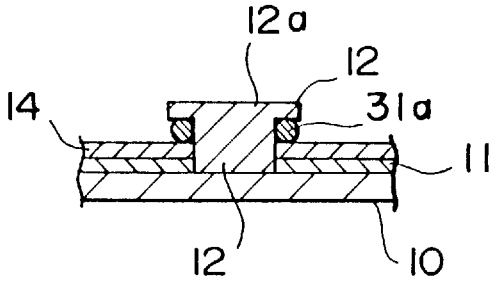
FIG. 19 is a cross-section drawing viewed along line E—E shown in FIG. 18.
Figure 20:
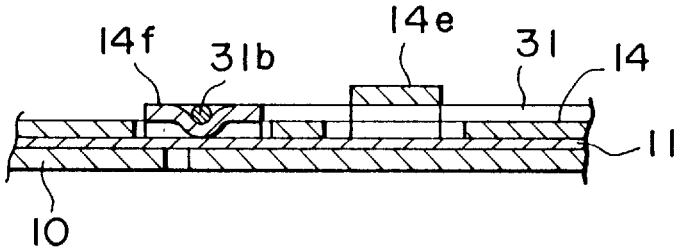
FIG. 20 is a cross-section drawing viewed along line F—F shown in FIG. 18.

FIG. 18 is a plan view of an antenna mount illustrating another embodiment of the present invention, FIG. 19 is a cross-section drawing viewed along line E—E shown in FIG. 18, and FIG. 20 is a cross-section drawing viewed along line F—F shown in FIG. 18.

The antenna mount according to the present invention is provided with the rotation prevention means 20, and also is provided with movement restricting means 30 which restricts the shifting of the antenna mounting base 14 relative to the base plate 11.

The motion restriction means 30 is comprised of a U-shaped spring 31 with an edge portion 31*a* which intervenes between the flange 21*a* of the guide pins 12 and the antenna mounting base 14, a tunnel-shaped guide portion 14*e* which is formed in the antenna mounting base 14 by means of raising a portion of the antenna mounting base 14 so as to straddle the spring 31, and a positioning portion 14*f* which is formed in the antenna mounting base 14 by means of raising a portion of the antenna mounting base 14 for positioning the base portion 31*b* of the spring 31.

With the above-described antenna mount, when the antenna 13 is to be attached to the trunk of an automobile, the antenna is rotated in a clockwise direction as viewed from above. The guide pins 12 are pressed into the springs 31 via the leading edge portions thereof which are opened wider than the diameter of the guide pins 12, and are nipped in the radial direction by means of the resilient force thereof. With this arrangement, movement of the guide pins are restricted in the horizontal direction in relation to the antenna mounting base 14 by means of the springs 31, and restriction in the vertical direction is also restricted due to the springs 31 being provided between the flanges 12*a* of the guide pins 12 and the antenna mounting base 14.

Seventh Embodiment

Figure 21:
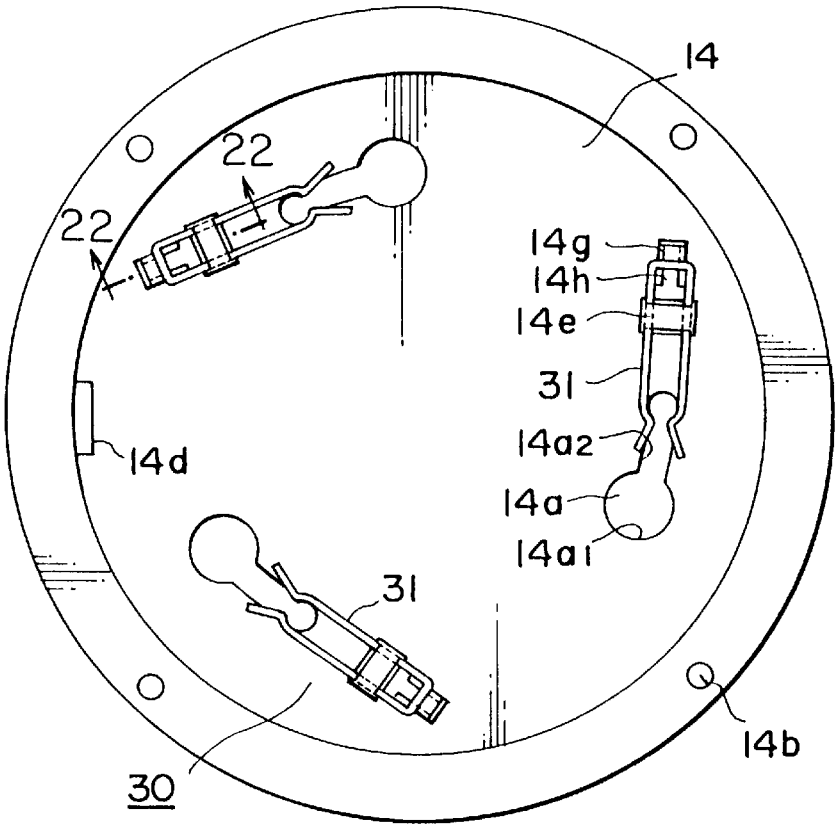
FIG. 21 is a plan view of the base plate illustrating another embodiment of the present invention.
Figure 22:
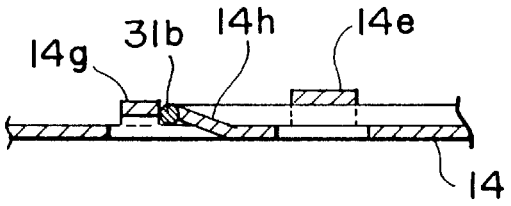
FIG. 22 is a cross-section drawing viewed along line G—G shown in FIG. 21.
Figure 23:
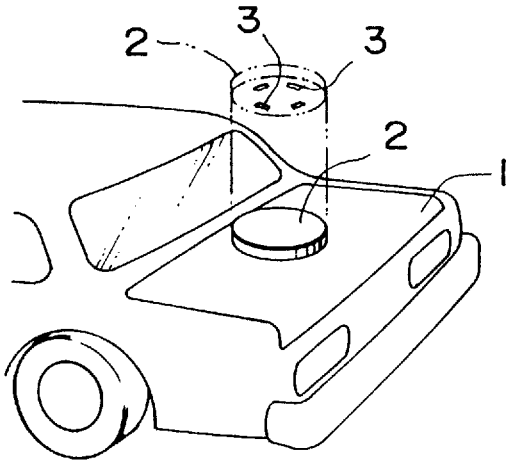
FIG. 23 is a perspective view illustrating a known flat-type automobile antenna mounted to the trunk of an automobile.

FIG. 21 is a plan view of a base plate illustrating another embodiment of the present invention, and FIG. 22 is a cross-section drawing viewed along line G—G shown in FIG. 21.

The present embodiment differs from the sixth embodiment in that the positioning portion described in the sixth embodiment is comprised of abutting portions 14*g* and raised portions 14*h*. The base portions 31*b* of the springs 31 are positioned by means of the abutting portions 14*g* and raised portions 14*h*.

With the present embodiment, the base portion 31*b* of the spring 31 is pushed in from the guide portion 14*e* until it is pressed against the abutment portion 14*g*, following which the raised portion 14*h* is raised to the height of the base portion 31*b* of the spring 31 so that the base portion 31*b* of the spring 31 is nipped between the abutting portion 14*g* and raised portion 14*h*, thus positioning the insertion direction of the spring 31.

As described above, with the antenna mount according to the present invention, guide pins are inserted into insertion portions of guide holes and the base plate and antenna mounting base are rotated relative to one another, wherein the flanges of the guide pins are retained at the retaining portions, so that the antenna can be easily mounted and removed to and from the antenna receiving surface.

Also, the base plate is formed as a doughnut-shaped plate, so that even when the curvature of the surface to which it is to be attached is great, the base plate is more capable of following the curvature thereof than a plate-shaped base plate, resulting in a more stable fixing of the base plate to the antenna receiving member.

Also, rotation prevention means for preventing rotation of the antenna mounting base have been provided, so that the antenna does not rotate and become dislodged due to vibrations during operating of the automobile or the like.

Further, the antenna rotating and becoming dislodged can be prevented with rotation prevention means of a simple structure, comprising a slider which is provided slidably on the base plate, a slider guide which has a screw hole and which is fixed to the base plate, and a bolt with a head which is movably inserted thorough a hole formed in the slider.

Further yet, rotation of the antenna can be prevented in a sure manner by the forming of a concave portion on the antenna mounting base into which the leading edge of the slider is inserted, so as to prevent the antenna becoming dislodged from the antenna receiving member.

Moreover, the base plate is provided with a retaining member which faces a retaining hole provided in the slider and cooperates with the retaining hole so as to restrict the amount of retraction of the slider, so that the slider becoming dislodged and lost due to vibrations during operating of the automobile or during removing of the antenna can be prevented.

Moreover yet, a bolt abutting portion is provided so as to abut the head of the bolt, so that the slider follows the retracting motion of the bolt upon rotation thereof, thus improving the ease of work of removing the antenna.

Also, the axial direction of the bolt and the direction of movement of the slider which slides on the base plate intersect, so that when the bolt is rotated to a certain extent the bolt comes in contact with the inner wall surface of a hole provided in the slider and making any further rotation of the bolt impossible, thus preventing the bolt or slider falling out during removing of the antenna, etc.

Further, movement restricting means are provided between the flanges of the guide pins and the antenna mounting base so that movement thereof in either vertical or radial directions is restricted, and consequently the antenna is firmly fixed to the antenna receiving member.

Further yet, protrusions comprising the movement restricting means are provided in the vicinity of the retaining portion of the guide holes, so that the antenna is firmly fixed to the antenna receiving member with a simple structure.

Moreover, movement restricting means are provided comprising a U-shaped spring which nips in an resilient manner, a tunnel-shaped guide portion which is formed in the antenna mounting base by means of raising a portion of the antenna mounting base into which the spring is inserted, and a positioning portion for positioning the spring to be inserted into the guide portion, so that the antenna is firmly fixed to the antenna receiving member, and manufacturing costs are also reduced owing to employing the material comprising the antenna mounting base for fixing the spring.

What is claimed is:

1. An antenna mount for mounting an antenna to a substantially horizontal surface of a vehicle, comprising:

a base plate to be mounted on the vehicle surface;

an antenna mounting base to be mounted to a base surface of an antenna; and a plurality of guide pins each having a flange and being secured either to said base plate or to said antenna mounting base, wherein guide holes are formed in whichever of said base plate or said antenna mounting base, said guide pins are not secured, said guide holes further comprising insertion portions into which said guide pins are inserted and retaining portions by means of which retaining of said guide pins is performed, and wherein said flanges of said guide pins are retained by said retaining portions, by means of inserting said guide pins into said insertion portions and rotating said base plate and said antenna mounting base relative to one another.

2. An antenna mount according to claim 1, wherein said base plate is doughnutshaped.

3. An antenna mount according to claim 1, wherein rotation prevention means is provided on said base plate to prevent rotation of said antenna mounting base.

4. An antenna mount according to claim 1, further comprising motion restriction means, said means being provided between said flanges of said guide pins and said antenna mounting base, so as to restrict movement of said guide pins in the radial and axial directions.

5. An antenna mount according to claim 4, wherein said motion restriction means comprises protrusions provided in the vicinity of said retaining portions of said guide holes.

6. An antenna mount according to claim 4, said motion restriction means further comprising:

U-shaped springs which grip said guide pins in an resilient manner;

tunnel-shaped guide portions which are formed in said antenna mounting base by means of raising a portion of said antenna mounting base, said springs being inserted thereto; and positioning portions which are formed in said antenna mounting base for positioning said springs to be inserted into said guide portions.

7. An antenna mount comprising:

a base plate to be mounted on an antenna receiving member:

an antenna mounting base to be mounted to a base surface of an antenna; and a plurality of guide pins each having a flange and being secured either to said base plate or to said antenna mounting base, wherein guide holes are formed in whichever of said base plate or said antenna mounting base, said guide pins are not secured, said guide holes further comprising insertion portions into which said guide pins are inserted and retaining portions by means of which retaining of said guide pins is performed, and wherein said flanges of said guide pins are retained by said retaining portions, by means of inserting said guide pins into said insertion portions and rotating said base plate and said antenna mounting base relative to one another, wherein said base plate is doughnut shaped, wherein rotation prevention means is provided on said base plate to prevent rotation of said antenna mounting base;

and wherein said rotation prevention means further comprises:

a slider provided on said base plate;

a slider guide fixed to said base plate and having a screw hole; and a bolt having a head, said bolt being movable inserted into a hole formed in said slider and screwed into said screw hole;

wherein the advancement of said bolt being screwed into said screw hole causes advancement of said slider so as to effectuate engagement of said slider with said antenna mounting base.

8. An antenna mount according to claim 7, wherein said antenna mounting base is provided with a concave portion into which the leading edge of said slider is inserted.

9. An antenna mount according to claim 7, wherein said slider is provided with a retaining hole, and said base plate is provided with a retaining member which reaches said retaining hole and cooperates with said retaining hole so as to restrict the amount of retraction of said slider.

10. An antenna mount according to claim 7, wherein said slider is provided with a bolt abutting member which abuts on said bolt and causes said slider to follow retraction of said bolt.

11. An antenna mount according to any of the claim 7, wherein the axial line of said bolt is arranged so as to intersect the direction of motion of the slider portion of said slider which slides upon said base plate.

* * * * *